US012076600B2

(12) United States Patent
Neuhaus

(10) Patent No.: US 12,076,600 B2
(45) **Date of Patent: *Sep. 3, 2024**

(54) MOTORIZED STRENGTH TRAINING APPARATUS WITH SELECTABLE FORCE MULTIPLICATION

(71) Applicant: OxeFit, Inc., Plano, TX (US)

(72) Inventor: Peter Neuhaus, Pensacola Beach, FL (US)

(73) Assignee: OxeFit, Inc., Plano, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/428,098

(22) Filed: Jan. 31, 2024

(65) Prior Publication Data

US 2024/0165449 A1 May 23, 2024

Related U.S. Application Data

(63) Continuation of application No. 17/495,584, filed on Oct. 6, 2021, now Pat. No. 11,925,827.

(51) Int. Cl.
*A63B 21/005* (2006.01)
*A63B 21/00* (2006.01)

(52) U.S. Cl.
CPC ..... *A63B 21/0058* (2013.01); *A63B 21/156* (2013.01); *A63B 21/00069* (2013.01); *A63B 21/4035* (2015.10); *A63B 21/4043* (2015.10)

(58) Field of Classification Search
CPC ..... A63B 21/0058; A63B 21/156; A63B 21/00069; A63B 21/4035; A63B 21/4043
See application file for complete search history.

(56) References Cited

U.S. PATENT DOCUMENTS

| | | | | |
|---|---|---|---|---|
| 4,645,210 | A * | 2/1987 | Patsy | F41J 9/02 273/406 |
| 5,409,435 | A | 4/1995 | Daniels | |
| 5,435,798 | A | 7/1995 | Habing et al. | |
| 6,066,077 | A * | 5/2000 | Horst | A63B 21/153 482/114 |
| 7,278,958 | B2 | 10/2007 | Morgan | |
| 8,075,453 | B1 | 12/2011 | Wilkinson | |
| 8,523,743 | B1 | 9/2013 | Miles et al. | |
| 9,539,458 | B1 | 1/2017 | Ross | |
| 9,814,920 | B1 | 11/2017 | Monterrey | |
| 10,143,880 | B1 | 12/2018 | Boatwright | |
| 10,814,172 | B1 * | 10/2020 | Ilfrey | A63B 23/035 |
| 11,007,398 | B2 | 5/2021 | Neuhaus et al. | |
| 11,707,646 | B2 | 7/2023 | Rubin et al. | |
| 2005/0032612 | A1 | 2/2005 | Keiser | |

(Continued)

OTHER PUBLICATIONS

International Search Report and Written Opinion in PCT/US2022/045495 Dtd Jan. 13, 2023.

*Primary Examiner* — Andrew S Lo
(74) *Attorney, Agent, or Firm* — Foley & Lardner LLP

(57) ABSTRACT

An exercise apparatus includes a cable, a motor configured to apply a tension to the cable, a first pulley, a second pulley, a first connection point configured to selectively redirect the cable through a gap between the first pulley and the second pulley such that the first connection point experiences a first force corresponding to double the tension, and a second connection point coupled to the cable and experiencing a second force corresponding to the tension.

20 Claims, 6 Drawing Sheets

(56) References Cited

U.S. PATENT DOCUMENTS

| | | | |
|---|---|---|---|
| 2005/0143230 | A1 | 6/2005 | Dalebout et al. |
| 2009/0023561 | A1 | 1/2009 | Ross et al. |
| 2009/0029835 | A1 | 1/2009 | Ellis |
| 2012/0202656 | A1 | 8/2012 | Dorsay |
| 2014/0038777 | A1 | 2/2014 | Bird |
| 2014/0162854 | A1 | 6/2014 | Watterson |
| 2014/0274600 | A1 | 9/2014 | Dalebout et al. |
| 2015/0335951 | A1 | 11/2015 | Eder |
| 2018/0021623 | A1 | 1/2018 | Brendle |
| 2018/0214729 | A1 | 8/2018 | Rubin et al. |
| 2018/0243599 | A1 | 8/2018 | Lacey |
| 2019/0046830 | A1 | 2/2019 | Chiavegato et al. |
| 2019/0076691 | A1 | 3/2019 | Smith |
| 2019/0099637 | A1 | 4/2019 | Valente et al. |
| 2019/0344123 | A1 | 11/2019 | Rubin et al. |
| 2021/0236876 | A1 | 8/2021 | Gregory |
| 2022/0047909 | A1 | 2/2022 | Beecroft et al. |
| 2022/0118304 | A1 | 4/2022 | McNally et al. |
| 2022/0184452 | A1 | 6/2022 | Valente et al. |
| 2022/0339481 | A1 | 10/2022 | Peal et al. |
| 2022/0339488 | A1 | 10/2022 | Belson et al. |

* cited by examiner

MOTORIZED STRENGTH TRAINING APPARATUS WITH SELECTABLE FORCE MULTIPLICATION

CROSS-REFERENCE TO RELATED APPLICATION

This application claims the benefit of and priority to U.S. patent application Ser. No. 17/495,584 filed Oct. 6, 2021, the entire disclosure of which is incorporated by reference herein.

BACKGROUND

The present disclosure relates generally to exercise equipment, in particular equipment for strength training exercises. Some embodiments herein relate to motorized strength training systems which use electric motors to generate forces experienced by users while performing exercises.

SUMMARY

One implementation of the present disclosure is an exercise apparatus. The exercise apparatus includes a first cable, a first motor configured to apply a tension to the first cable, a pair of pulleys, and a terminal. The first cable extends from the first motor, past the pair of pulleys, and to the terminal, and the terminal constrains a distal end of the first cable from retracting toward the first motor away from the terminal such that at least a minimum length of the first cable is maintained between the first motor and the terminal. The exercise apparatus also includes a first connection point between the pair of pulleys, wherein the first connection point is configured to selectively redirect the cable between the pair of pulley such that the first connection point experiences a first force corresponding to double the tension.

In some embodiments, the first connection point includes a loop and the first cable extends through the loop. The first connection point is moveable through a gap between the pair of pulleys to a position where the cable is redirected by the first connection point between the pair of pulleys. When the first connection point is moved to a first side of the pair of pulleys through the gap, the tension is provided both between the first connection point and a first pulley of the pair of pulleys and between the first connection point and a second pulley of the pair of pulleys such that the first connection point experiences the first force corresponding to double the tension.

In some embodiments, the exercise apparatus also includes a second connection point at the distal end of the second cable such that the second connection point experiences a second force corresponding to the tension. The second force is half the first force. In some embodiments, the exercise apparatus also includes a handle connectable to the first connection point and the second connection point at different times.

In some embodiments, the first connection point is selectable to enable exercises resisted by the first force and the second connection point is selectable to enable exercises resisted by the second force. The motor may be controllable to dynamically adjust the tension and the first force.

In some embodiments, the exercise apparatus also includes a base and a stanchion extending from the base. The terminal may be positioned at the stanchion and the pair of pulleys may be positioned at the base. The terminal may be vertically repositionable along the stanchion. The exercise apparatus may also include a bar configured to be coupled to the first connection point. The bar and the first connection point can enable an exercise in which the bar moves vertically relative to the base and the first force points toward the base.

Another implementation of the present disclosure is a method. The method includes operating a motor to exert a tension on a cable, selecting between a first option and a second option by connecting, to select the first option, an exercise implement to a distal end of the cable, the cable extending from the distal end to motor to select the first option, and connecting, to select the second option, the exercise implement to a moveable pulley positioned between the distal end of the cable and the motor. The moveable pulley is moveable relative to a first fixed pulley and a second fixed pulley. The method also includes, performing, with the first option selected, a first exercise resisted by a first force corresponding to the tension, and performing, with the second option selected, a second exercise resisted by a second force corresponding to double the tension.

In some embodiments, a relationship between the moveable pulley, the first fixed pulley, and the second fixed pulley causes the second force to be double the tension. The tension may pull the moveable pulley toward the first fixed pulley and also pull the moveable pulley toward the second fixed pulley such that the second force corresponds to double the tension.

In some embodiments, performing the first exercise includes moving the cable along the first fixed pulley and the second fixed pulley. Performing the second exercise may include moving the cable along the first fixed pulley while a position along the cable stays at the second fixed pulley.

In some embodiments, the method also includes dynamically adjusting the tension by controlling the motor. Dynamically adjusting the tension may include providing a first tension during a first phase of an exercise and a second tension during a second phase of the exercise. Controlling the motor may include receiving, at a controller, an indication of whether a user selected the first option of the section option, and controlling the motor based on the indication. In some embodiments, the second exercise is a squat exercise or a bench press exercise.

This summary is illustrative only and is not intended to be in any way limiting.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Referring generally to the figures, an exercise apparatus and methods relating thereto are shown. In particular, an exercise apparatus configured as a motorized strength training apparatus is shown. In the motorized strength training apparatus described herein, an electric motor operates to generate a tension in a cable. An exercise implement such as a handle, bar, etc. can be connected to the cable such that the tension is communicated to the exercise implement and a force is exerted on a user holding (or otherwise in contact with) the exercise implement.

One aspect of the present disclosure is a determination that some electric motors may be well-suited for relatively low-force and relatively high-speed changes in tension and would be best for relatively-light-force exercises (e.g., less than 50 kilograms), but may not be able to achieve the same level of performance when higher forces are desired for an exercise (e.g., more than 50 kilograms), while other motors may have different performance characteristics (e.g., provide high forces but do not provide smooth performance at lower forces). Accordingly, it would be advantageous to provide features which extend the range of capabilities of a given electric motor to enable a larger number of exercises, a larger range of resistances, etc. Achieving such an extension without adding internal complexity to the motor (e.g., gearing, etc.) may also be desirable.

As described in detail below, the figures show an exercise apparatus which allows a user to select between a first configuration in which the force on an exercise implement (handle, bar, etc.) held by the user corresponds to (e.g., is substantially equal to) the tension in the cable and a second configuration in which the force on the exercise implement corresponds to double the tension on the cable due to a routing of the cable across multiple pulleys. This selective doubling of the force generated by the motor enables a single motor to be used to generate suitable forces for a wider range of exercises than in embodiments without such features. These and other advantages of the present disclosure are described in further detail below with reference to the figures.

Figure 1:
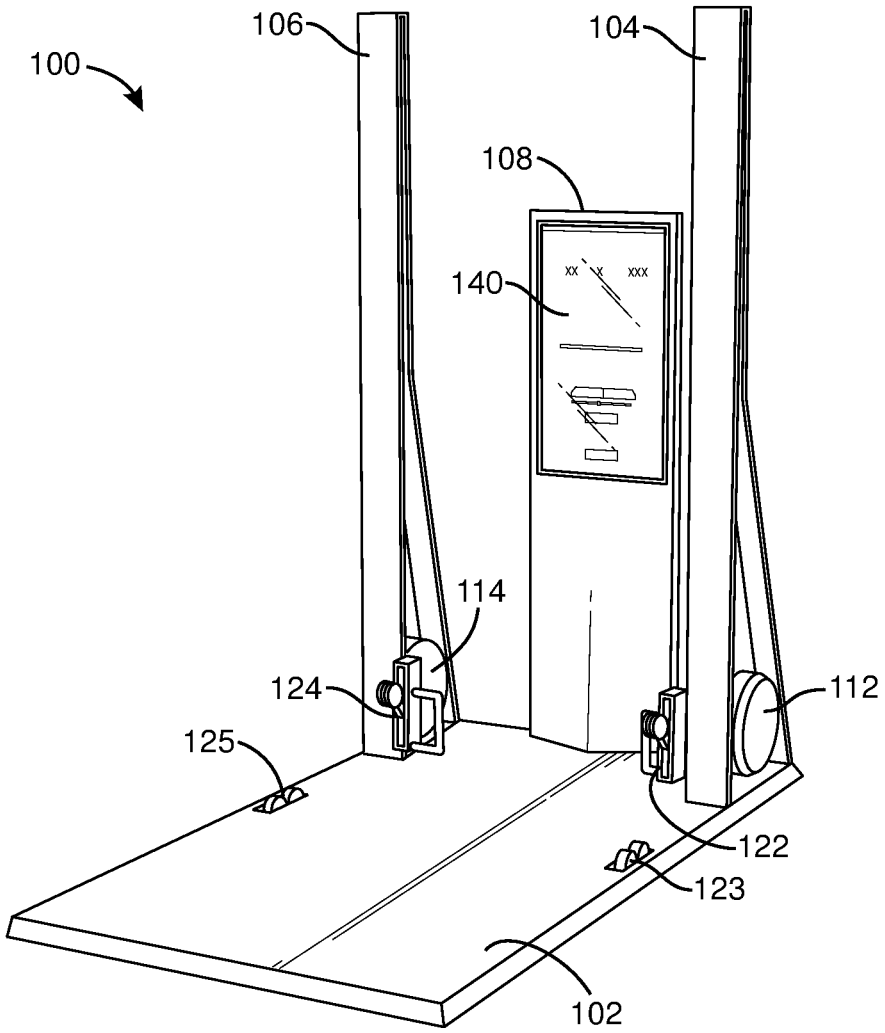
FIG. 1 is a perspective view of an exercise assembly, according to some embodiments.

Referring now to FIG. 1, an exercise apparatus 100 is shown, according to some embodiments. The exercise apparatus 100 includes a base platform 102, a first stanchion 104 extending vertically from the base platform 102 proximate a first end of the base platform 102, a second stanchion 106 extending vertically from the base platform 102 proximate the first end of the base platform 102, a display console 108 coupled to the base platform 102 and positioned between the first stanchion 104 and the second stanchion 106. The exercise apparatus can also include a bench selectively positionable on the base platform 102. The exercise apparatus 100 also includes a first motor 112 positioned on the base platform 102 at the first stanchion 104 and a second motor 114 positioned on the base platform 102 at the second stanchion 106.

The exercise apparatus 100 also includes a first cable 118 (shown in FIGS. 2-4) extending from the first motor 112 and a second cable 120 (shown in FIGS. 3-5) extending from the second motor 114. The exercise apparatus 100 also includes a first terminal 122 coupled to the first stanchion and repositionable along the first stanchion 104, and a first set of pulleys 123 positioned at the base platform 102. In the state shown in FIG. 1, the first cable 118 extends from the first motor 112 along the first set of pulleys 123 to the first terminal 122, for example via the routing shown in FIG. 2 and described in detail below with reference thereto.

The exercise apparatus 100 also includes a second terminal 124 coupled to the second stanchion 106 and repositionable along the second stanchion 106, and a second set of pulleys 125 positioned at the base platform 102. In the state shown in FIG. 1, the second cable 120 extends from the second motor 114 along the second set of pulleys 125 to the second terminal 124.

As shown in FIG. 1, the base platform 102 is substantially planar is configured to stably rest on a floor or other ground surface to provide a stable foundation for the exercise apparatus 100. The base platform 102 can define an exercise surface on which a user can perform one or more exercise and/or on which the bench 110 can be positioned. In some embodiments, the base platform 102 is configured to be at least partially foldable into an out-of-use configuration in which the base platform 102 is folded up and away from the floor or ground under the base platform 102 (thereby reducing the space occupied by the exercise apparatus 100 when not in use).

The display console 108 may be configured to display information relating to operation of the exercise apparatus 100 to a user. As shown in FIG. 1, the display console 108 includes a screen 140 (e.g., LED screen). In some embodiments, the screen 140 is a touchscreen configured to accept user input. In other embodiments, one or more additional buttons, keys, toggles, etc. are included on the display console 108 to receive user input. In some embodiments, the display console 108 includes one or more speakers configured to emit sounds relating to operation of the exercise apparatus 100. In some embodiments, the exercise apparatus 100 alternatively or additionally includes a virtual reality or augmented reality headset configured to be worn by a user and to display information relating to operation of the exercise apparatus 100 to the user. In some embodiments, the display console 108 houses a controller for the exercise apparatus 100.

The first stanchion 104 and the second stanchion 106 extend upwards from the base platform 102 and are spaced apart from one another near an end of the base platform 102. The first stanchion 104 and the second stanchion 106 are shown as being substantially symmetric across a center line of the base platform 102. As shown in FIG. 1, the first stanchion 104 and the second stanchion 106 are substantially the same height. The first stanchion 104 and the second stanchion 106 may be approximately six feet tall, for example with a height in a range between five feet and seven feet, as in the example of FIG. 1. In other embodiments, the first stanchion 104 and the second stanchion 106 may be shorter, for example with a height in a range between two feet and four feet.

The first terminal 122 is coupled to the first stanchion 104 and is configured to be selectively repositioned along the first stanchion 104. For example, the first terminal 122 may include a projection that rides along a groove or slot of the first stanchion 104 (or vice-versa) and can be selectively held in place at various heights using a pin configured to engage apertures of the first stanchion 104. The first terminal 122 can include a handle to facilitate repositioning of the first terminal 122. The second terminal 124 is coupled to the second stanchion 106 and is configured to be selectively repositioned along the second stanchion 106. For example, the second terminal 124 may include a projection that rides along a groove or slot of the second stanchion 106 (or vice-versa) and can be selective held in place at various heights using a pin configured to engage apertures of the second stanchion 106. The second terminal 124 can include a handle to facilitate repositioning of the second terminal 124. Accordingly, the first terminal 122 and the second terminal 124 can be repositioned (e.g., manually by a user) to various heights along the first stanchion 104 and the second stanchion 106, i.e., at various heights above the base platform 102. In some embodiments, actuators (e.g., linear actuators) are included in the first stanchion 104 and the second stanchion 106 to automatically move the first terminal 122 and the second terminal 124.

The first motor 112 is shown as being positioned on the base platform 102 at a bottom end of the first stanchion 104. The first motor 112 is operationally coupled to the first cable 118 such that the first motor 112 can generate tension in the first cable 118. In some examples, the first motor 112 can include an electric motor coupled to a spool such that the electric motor operates to generate a torque that rotates the spool. In such examples, the spool is coupled to the first cable 118 such that the first cable 118 can be repeatedly wound and unwound from the spool of the first motor 112 by operation of the first motor 112.

The first motor 112 is configured to controllably generate a force that acts both acts to retract the first cable 118 towards the first motor 112 and to resists the first cable 118 from being pulled out (unspooling, releasing) from the first motor 112. Thus, as detailed below, the first motor 112 can provide a controllable tension in the first cable 118 in different phases (e.g., concentric and eccentric phases) of exercises performed using the exercise apparatus 100, for example providing different amounts of tension in different phases or otherwise dynamically altering the tension. In some embodiments, the first motor 112 includes a permanent magnet direct current motor. In various embodiments, the first motor 112 includes a belt, a gear, a set of gears, various gearing, etc.

The second motor 114 is shown as being positioned on the base platform 102 at a bottom end of the second stanchion 106. The second motor 114 is operationally coupled to the second cable 120 such that the second motor 114 can generate tension in the second cable 120. Other than acting on the second cable 120 rather than the first cable 118, the second motor 114 is configured substantially the same as the first motor 112 in the examples shown.

Figure 2:
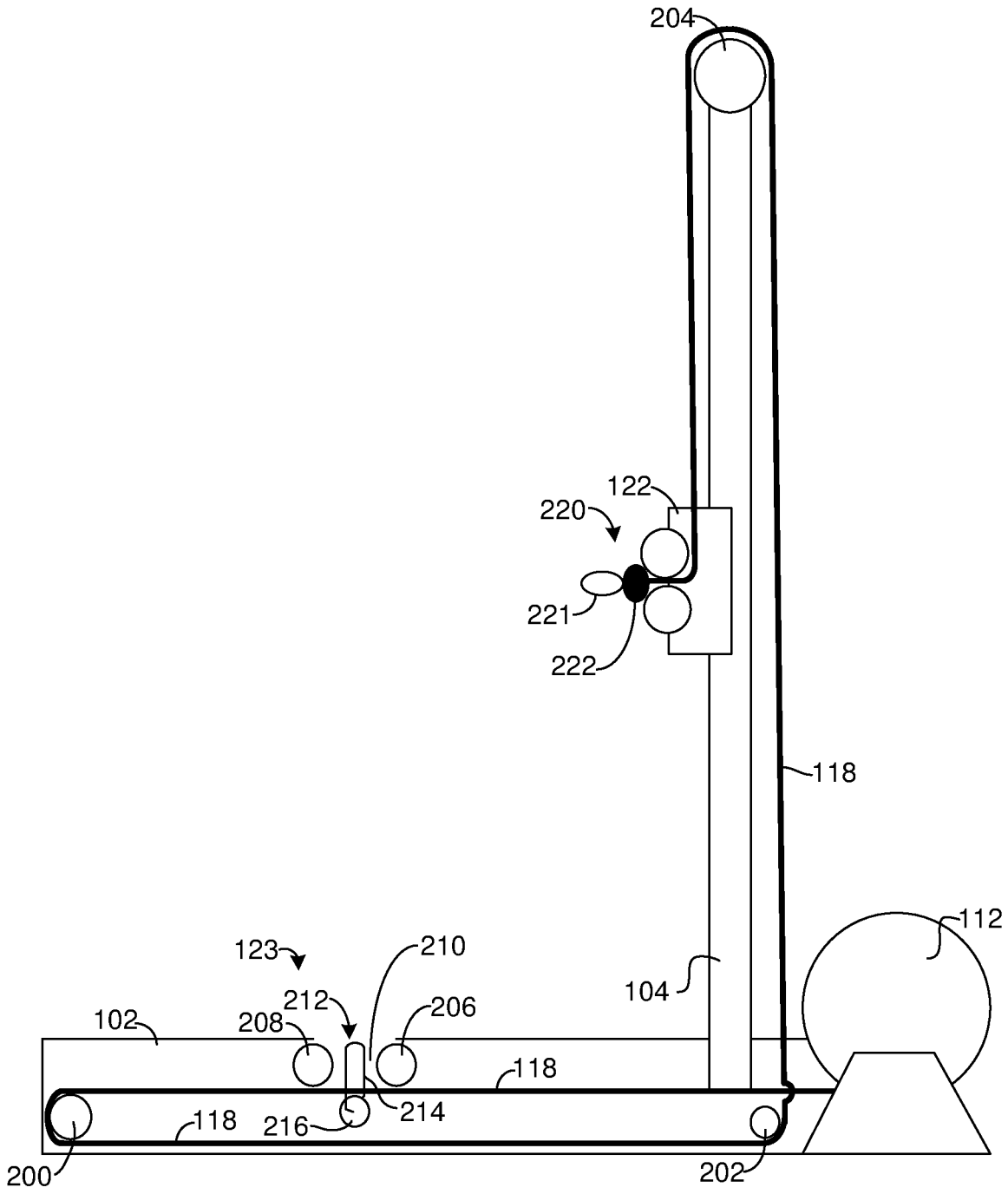
FIG. 2 is a schematic side view of the exercise assembly of FIG. 1, according to some embodiments.

Referring now to FIG. 2, a schematic side-view showing a routing of the first cable 118 from the first motor 112 to the first terminal 122 via the first set of pulleys 123 is shown, according to some embodiments. As shown in FIG. 2, the exercise apparatus also includes a base pulley 200, a lower stanchion pulley 202, and an upper stanchion pulley 204 around which the first cable 118 is routed as detailed below. While FIG. 2 shows the routing of the first cable 118, the second cable 120 may be similarly routed and the second cable 120, second terminal 124, second set of pulleys 125, etc. may be configured the same as described below for the first cable 118, first terminal 122, first set of pulleys 123, etc., and additional pulleys corresponding to the base pulley 200, lower stanchion pulley 202, and the upper stanchion pulley 204 may be provided for the second cable 120.

As shown in FIG. 2, the first cable 118 extends out from the first motor 112 along the base platform 102 (e.g., within the base platform 102) in a longitudinal direction of the base platform 102 and approximately perpendicular to the first stanchion 104. The first cable 118 first passes through the first set of pulleys 123 before reaching the base pulley 200. The base pulley 200 is located at the base platform 102 such that the first set of pulleys 123 are between the first stanchion 104 and the base pulley 200. The cable 118 is routed around the base pulley 200 such that the base pulley 200 reverse the direction of the cable 118 back toward the first stanchion 104.

FIG. 2 further shows that the first cable 118 is routed from the base pulley 200 to the lower stanchion pulley 202, which is located at a bottom of the first stanchion 104 (e.g., proximate an intersection between the first stanchion 104 and the base platform 102). The lower stanchion pulley 202 redirects the first cable 118 upwards along the first stanchion to the upper stanchion pulley 204, which is located at a top end of the first stanchion 104. The cable 118 thus extends along substantially the entire height of the first stanchion 104. The upper stanchion pulley 204 redirects the first cable 118 downwards to the first terminal 122. The cable 118 thus sequentially passes the first set of pulleys 123, the base pulley 200, the lower stanchion pulley 202, and the upper stanchion pulley 204 to reach the first terminal 122 from the first motor 112.

As shown in FIG. 2, the first set of pulleys 123 includes a pair of fixed pulleys (first fixed pulley 206 and second fixed pulley 208) which are shown as fixed in position (i.e., not translatable) relative to the base platform 102. The first fixed pulley 206 may be rotatable about the axis of the first fixed pulley 206 and the second fixed pulley 208 may be rotatable about the axis of the second fixed pulley 208. The first fixed pulley 206 is spaced apart from second fixed pulley 208 in the direction of travel of the cable 118 at the first set of pulleys 123 (i.e., in the longitudinal direction of the base platform 102) such that a gap 210 is provided between the first fixed pulley 206 and the second fixed pulley 208.

The first set of pulleys 123 is also shown as including a first connection point 212. The first connection point includes a loop 214 through which the cable 118 extends and a moveable pulley 216. The moveable pulley 216 and the loop 214 are moveable relative to the first fixed pulley 206 and the second fixed pulley. The loop 214 is configured to be connected to an exercise implement, for example a handle or bar held by a user for performing an exercise. The moveable pulley 216 is configured (e.g., sized) to be selectively moved (e.g., by a user) through the gap 210 by action of the user on the loop 214 (e.g., via the exercise implement).

When the first connection point 212 and the moveable pulley 216 are in the position shown in FIG. 2, the first connection point 212 and the moveable pulley 216 allow the cable 118 to pass by without substantially redirecting the cable 118. Action of the cable 118 and/or gravity may pull the moveable pulley 216 and the first connection point 212 into the state shown in FIG. 2 when an external force is not exerted on the first connection point 212 (e.g., when a user is not interactive with the first connection point 212) such that FIG. 2 may be considered as showing a default position for the first connection point 212. In some embodiments, the moveable pulley 216 (e.g., a housing or external surface thereof) is of a ferrous metal and a magnet (e.g., permanent magnet) is located in the base 102 (e.g., proximate the position of 216 as in FIG. 2). In such embodiments, the magnet holds the moveable pulley 216 in place when not in use and is configures such that a user can overcome the magnetic force to initiate movement of the moveable pulley 216 through the gap 210.

Figure 3:
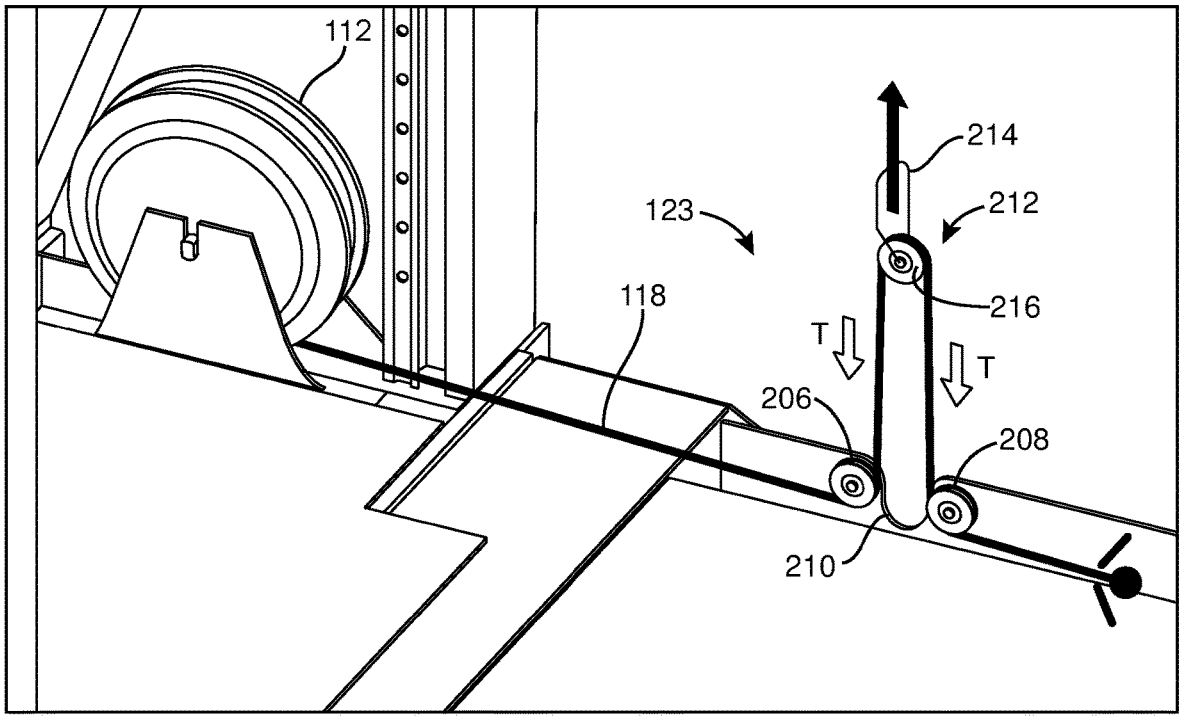
FIG. 3 is a perspective view of a portion of the exercise assembly of FIG. 1 in use to provide a multiplication of a force generated by a motor of the exercise assembly, according to some embodiments.

FIG. 3 illustrates the cable routing at the first set of pulleys 123 in a scenario where a user exerted an upwards force on the first connection point 212 to draw the moveable pulley 216 through the gap 210 between the first fixed pulley 206 and the second fixed pulley 208, according to some embodiments. The routing of the cable 118 and the forces provided on the first connection point 212 in such a scenario is described in detail below with reference to FIG. 3.

Still referring to FIG. 2, the distal end of the cable 118 is shown as including a second connection point 220. The second connection point 220 includes a loop (ring, etc.) 221 to which an exercise implement can be selectively connected. The second connection point 220 also includes a stopper 222 configured to prevent retraction of the distal end of the cable 118 past the first terminal 122 toward the first motor 112. The stopper 222 can be a ball of rubber, plastic, metal, etc. that is too large to fit though an opening in first terminal 122 through which the first cable 118 extends (e.g., having a diameter multiple times that of the cable 118). The length of cable between the first terminal 122 and the first motor 112 can change with adjustment of the position of the first terminal 122 along the first stanchion 104 and by movement of the first connection point 212 as described with reference to FIGS. 3-5. The stopper 222 is positioned so that the second connection point 220 can be pulled away from the first terminal 122 to cause extension of the cable 118 out from the first terminal 122. Operation of the motor 112 pulls the stopper 222 into contact with the first terminal 122 absent an external force (e.g., from a user) on the second connection point 220.

Figure 6:
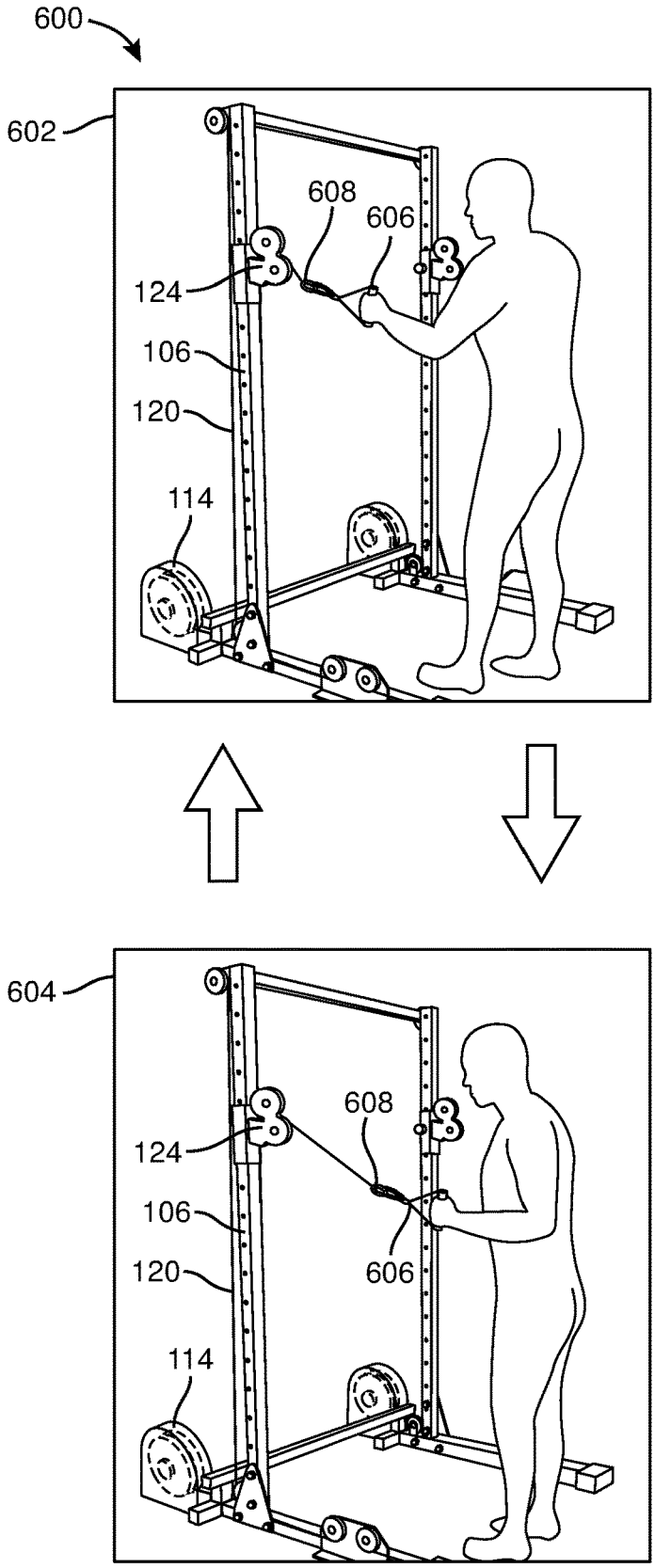
FIG. 6 is a storyboard-style illustration of operation of the exercise assembly of FIG. 1 to provide a one arm row exercise, according to some embodiments.

The first terminal 122 and the second connection point 220 interact to allow an exercise to be performed by pulling on an exercise implement connected to the second connection point 220 (as shown in FIG. 6 and described with reference thereto) while preventing retraction of the cable past the first terminal 122. In such exercises, the force exerted at the second connection point 220 and experienced by a user corresponds to the tension generated by the motor 112 in substantially a one-to-one relationship (i.e., the tension in the first cable 118 is substantially equal to the force on the second connection point 220). A user can select to use the second connection point 220 for exercises when such levels of force and cable speed are suitable for performance of corresponding exercises.

Referring now to FIG. 3, a schematic perspective illustration of a portion of the exercise assembly 100 is shown, in a scenario where the first connection point 212 is in use and according to some embodiments. As shown in FIG. 3, the moveable pulley 216 is pulled above the first fixed pulley 206 and the second fixed pulley 208 through the gap 210 between the first fixed pulley 206 and the second fixed pulley 208.

The cable 118 is routed sequentially under the first fixed pulley 206, over the moveable pulley 216, and under the second fixed pulley 208. When the moveable pulley 216 is above the first fixed pulley 206 and the second fixed pulley 208 as shown in FIG. 3, the first cable 118 extends downwards from the moveable pulley 216 to the first fixed pulley 206 and from the moveable pulley 216 to the second fixed pulley 208. Moving the moveable pulley 216 causes a change in length of the first cable 118 between the motor 112 and the stopper 222 at the distal end of the first cable 118 (by drawing the first cable 118 out from the motor 112), while the distal end of the first cable 118 remains in a static position (e.g., the stopper 222 engages the first terminal 122 such that the stopper 222 cannot be pulled closer to the second fixed pulley 208).

The first motor 112 operates to generate a tension T in the first cable 118. When arranged as in FIG. 3, the relationship between the first fixed pulley 206 and the moveable pulley 216 is such that the tension T is present in the subsection of the first cable 118 between the first fixed pulley 206 and the moveable pulley 216, pulling the moveable pulley 216 toward the first fixed pulley 206. Additionally, the tension T is also present in the subsection of the first cable 118 between the second fixed pulley 208 and the moveable pulley 216, pulling the moveable pulley 216 toward the second fixed pulley 208. A total force on the moveable pulley 216 is thereby created which corresponds to double the tension T (e.g., F=2*T) generated by the motor. The set of pulleys 123 thereby acts as a force multiplier to double the force output by the motor.

Figure 4:
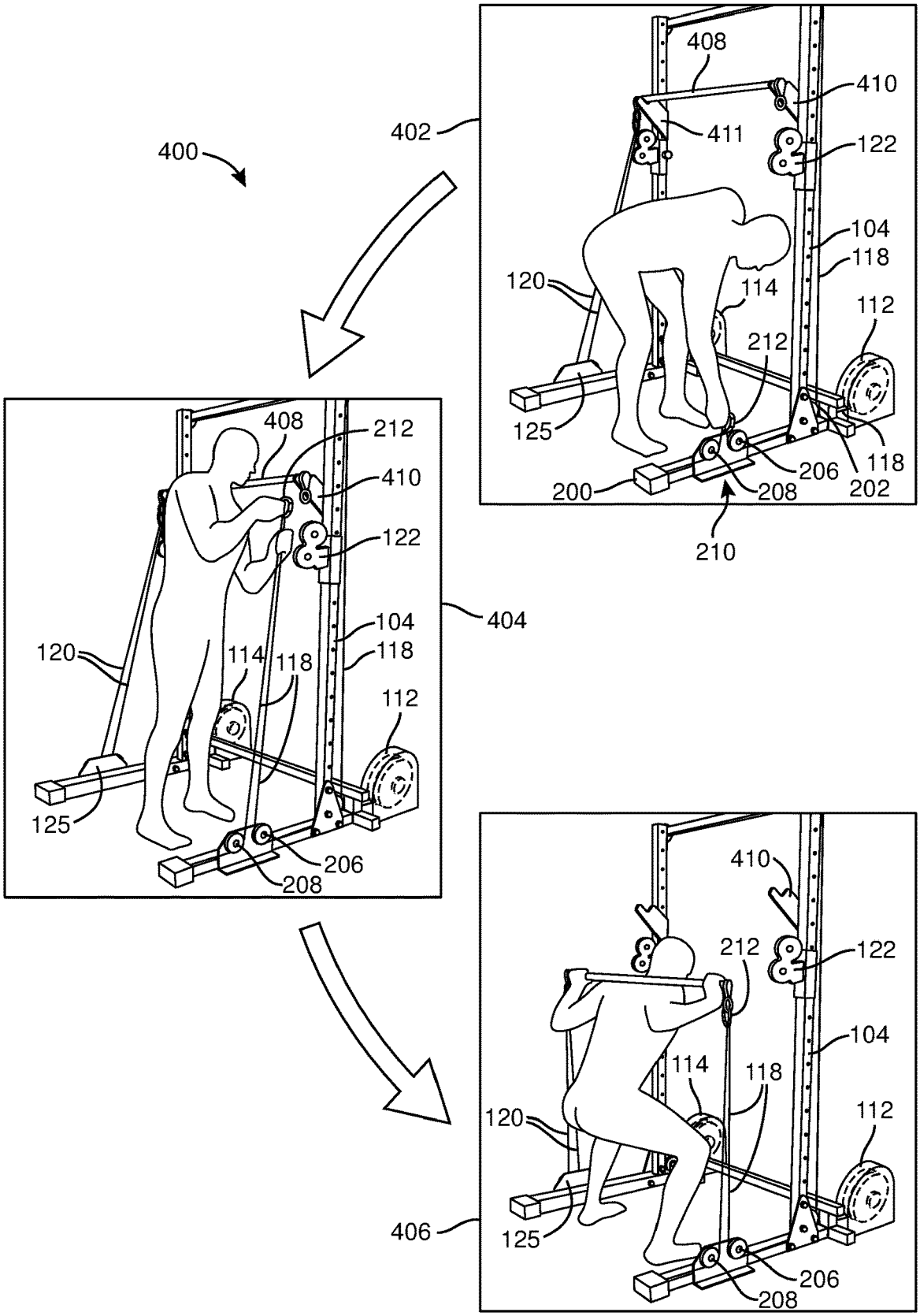
FIG. 4 is a storyboard-style illustration of operation of the exercise assembly of FIG. 1 to provide a squat exercise, according to some embodiments.
Figure 5:
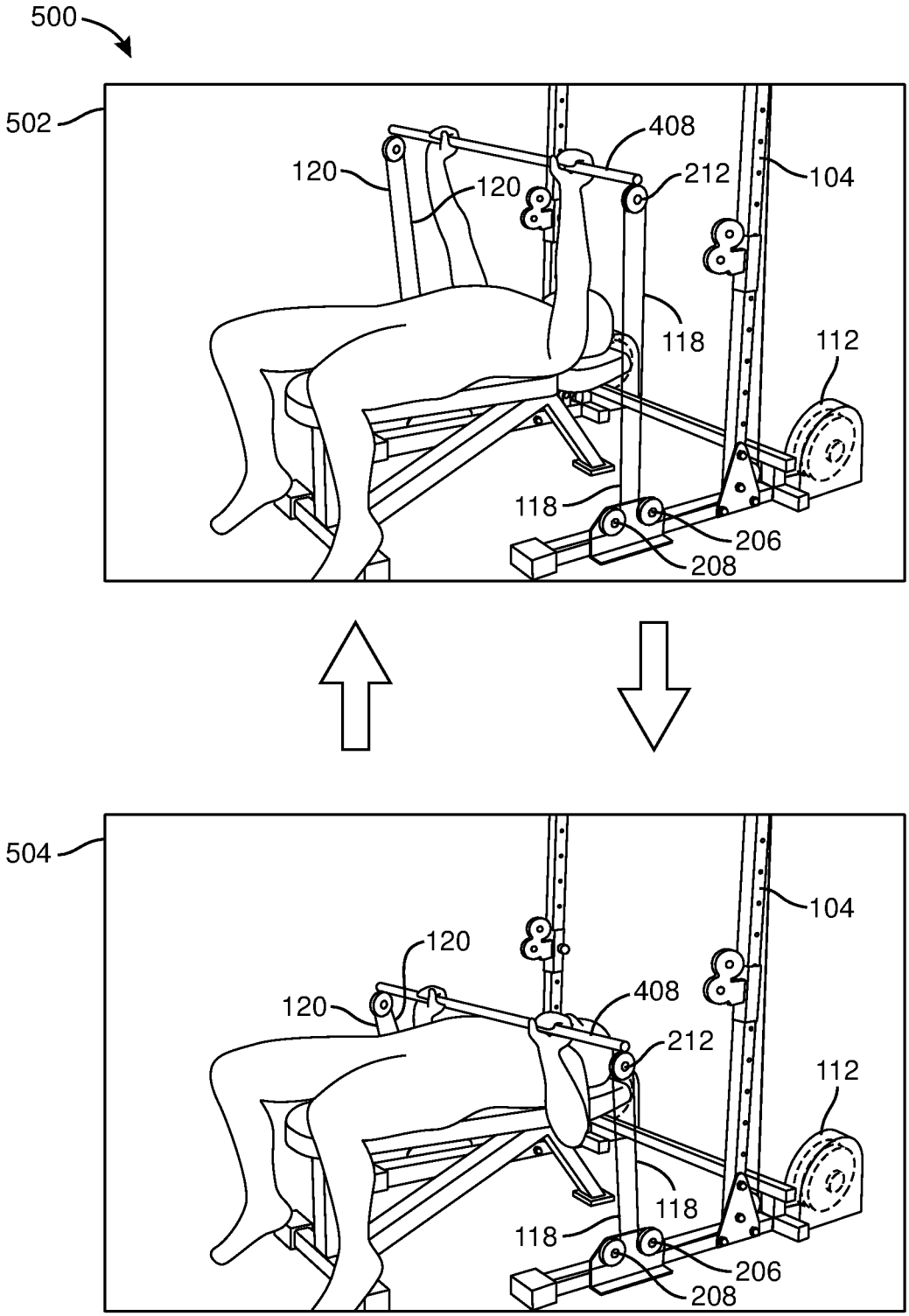
FIG. 5 is a storyboard-style illustration of operation of the exercise assembly of FIG. 1 to provide a bench press, according to some embodiments.

The loop 214 is coupled to the moveable pulley 216 and is configured to be coupled to an exercise implement such as a bar (e.g., as shown in FIGS. 4-5), grip, handle, etc. For example, a carabineer or other quick-release clip can be engaged with the loop 214 to couple the exercise implement to the loop 214 for performance of an exercise using the exercise implement. In other embodiments, the loop 214 is formed as a handle, grip, etc. configured to be held by a user during performance of an exercise. The loop 214 is coupled to the moveable pulley 216 such that the force on the moveable pulley 215 from the first cable 118 (i.e., approximately double the tension T in the cable 118) is communicated to the loop 214 and, when connected, to an exercise implement connected thereto. Exercises performed using the first connection point 212 with a bar connected to the loop 214 are shown in FIGS. 3-4 and described with reference thereto below.

Referring now to FIG. 4, a storyboard-style illustration 400 of operation of the exercise assembly 100 for performance of a squat exercise is shown, according to some embodiments. The illustration 400 includes a first frame 402, a second frame 404, and a third frame 406 showing steps of a process of operating the exercise assembly 100.

In the first frame 402, the exercise assembly 100 is shown as including a bar 408 resting on a first cradle 410 mounted on the first stanchion 104 and on a second cradle 411 mounted on the second stanchion 106. In the first frame 402, the bar 408 is connected to the second cable 120, but not connected to the first cable 118. The first frame 402 and the second frame 404 combine to show a process for connecting the first cable to the bar 408 to enable the bar 408 to be used for performance of an exercise subject to forces generated by the first motor 112 and the second motor 114.

As illustrated in the first frame 402, a user can grab the first connection point 212 from its position between the first fixed pulley 206 and the second fixed pulley 208, for example via the gap 210 between the first fixed pulley 206 and the second fixed pulley 208. In the first frame 402, the user begins to pulley the first connection point 212 upwards through the gap 210. Drawing the first connection point 212 upwards pulls on the first cable 118, causing additional length of the first cable 118 to be played out from the first motor 112. The first motor 112 may operate in a setup or transition mode to allow length of the first cable 118 to be relatively easily extracted from first motor 112 during a setup or transition phase before or between exercises (e.g., while substantially avoiding slack in the first cable 118 by providing a small tension), thereby facilitating the user in drawing the first connection point 212 upwards through the gap 210 and away from the first fixed pulley 206 and the second fixed pulley 208.

From the first frame 402 to the second frame 404, the user continues to move the first connection point 212 away from the first fixed pulley 206 and the second fixed pulley 208 and to the bar 408. When the first connection point 212 reaches the bar 408, the first connection point 212 can be connected to the bar 408. For example, the loop 214 of the first connection point 212 may include a carabineer or other type of clip or connector configured to selectively engage with a loop, ring, slot, hole, etc. of the bar 408. As another example, the bar 408 may include a carabineer or other type of clip or connector configured to selectively engage with the loop 214 of the first connection point 212.

The second frame 404 illustrates a user connecting the bar 408 to the first connection point 212, thereby creating a mechanical connection between the bar 408 and the first cable 118. Once connected, the tension in the first cable 118 is communicated to the bar 408, from both the section of the first cable 118 between the bar 408 and the first fixed pulley 206 and the section of the first cable 118 between the bar 408 and the second fixed pulley 208. The bar 408 is pulled towards the first fixed pulley 206 by the tension T created by the first motor 112 and toward the second fixed pulley 208 by the tension T created by the first motor 112. Due to the routing of the first cable 118, the force generated by the first motor 112 is thereby doubled for communication to the bar 408. The second cable 120 can be connected to the bar 408 in a similar manner, such that force generated by the second motor 114 is also doubled for communication to the bar 408.

The third frame 406 shows the exercise assembly 100 in use to perform a squat exercise. The first cable 118 is connected to one end of the bar 408 by the first connection point 212, while the second cable 120 is connected to an opposite end of the bar 408 by a corresponding connection point of the second set of pulleys 125 associated with the second cable 120 (e.g., configured the same as the first connection point 212 but adapted/positioned for use with the second cable 120). The exercise assembly 100 is shown as substantially symmetric along a longitudinal centerline or plane of the exercise assembly 100 (e.g., across the sagittal plane of the user shown in the third frame 406). For the squat exercise shown, the user has the bar 408 resting on the user's shoulders such that the user can exert vertical force on the bar 408 via the user's shoulders (e.g., by pressing the user's torso up with the user's legs). Other positions, grips, etc. are also enabled by the exercise assembly 100 for various other types and variations of exercises.

In the example shown, the first motor 112 operates to create a tension T 1 in the first cable 118 which is experienced at the bar 408 as a force corresponding to double the tension T 1, i.e., a force substantially equal to $2*T_1$. The second motor 114 operates to create a tension T 2 in the second cable 120, which is experienced at the bar 408 as a force corresponding to double the tension $T_2$, a force substantially equal to $2*T_2$. The total force on the bar 408 by the exercise assembly 100 in the example of the third frame 406 is therefore approximately $(2*T_1)+(2*T_2)=2*(T_1+T_2)$, i.e., double the tension generated by the first motor 112 plus double the tension generated by the second motor 114.

The direction of the force on the bar 408 by operation of the first motor 112 and the second motor 114 points downwards, in particular towards the first fixed pulley 206 and the second fixed pulley 208 and corresponding pulleys of the second set of pulleys 125 associated with the second cable 120. When performing a squat exercise as shown in the third frame 406, the user exerts an upwards force on the bar 408 in an opposing direction to the force on the bar 408 by the first cable 118 and the second cable 120 (i.e., generated by the first motor 112 and the second motor 114). If the force by the user exceeds double the force generated by the first motor 112 and the second motor 114, the bar 408 moves upwards. If the force by the user is less than double the force generated by the first motor 112 and the second motor 114, the bar 408 (and the user's torso) will move downwards. To perform the squat exercise, the user moves the user's torso up and down by repeatedly exerting various forces on the bar 408.

The first motor 112 and the second motor 114 can be controlled to dynamically vary the force on the bar 408 during a workout, for example between workout sets, between repetitions of an exercise within a set, or during individual repetitions (e.g., to provide a first force in an eccentric phase and a second force in a concentric phase). In some scenarios, the first motor 112 and the second motor 114 operate substantially the same to provide symmetric forces to the bar 408. In other scenarios, the first motor 112 and the second motor 114 may operate asymmetrically to provide an exercise with asymmetric loading on the user (e.g., promoting balance, core engagement, etc.). Various dynamic workouts can be provided with electronic control of the first motor 112 and the second motor 114 which cannot be achieved with conventional weight equipment in which resistance is created by gravitational forces on weighted plates.

In some embodiments, the bar 408 includes one or more inertial measurement units (inertial sensors, accelerometers, gyroscopes, etc.) configured sense movement of the bar 408. The one or more inertial measurement units can be configured to sense translation and/or rotation of the bar 408 and generate data indicative of a current pose of the bar 408 (e.g., based on detected movement and a known starting positon, for example). The inertial measurement units can be communicable with a controller (e.g., wirelessly) for the first motor 112 and the second motor 114 for use in controlling the first motor 112 and the second motor 114 based on the tracked pose of the bar 408.

In some embodiments, the bar 408 includes a button or other user input enabling a user to initiate or end an exercise by commanding the first motor 112 and the second motor 114 to start or stop providing tension in the first cable 118 and the second cable 120. For example, a button can be mounted on the bar 408 and may be wirelessly (e.g., Bluetooth, WiFi, NFC, ΔNT+, etc.) communicable with a controller for the first motor 112 and the second motor 114 to allow a user to enter command to start or stop applying force, to increase or decrease force, etc. In some embodiments, the display console 108 receives user inputs (e.g., via a touchscreen or other input device) that allows a user to input commands relating to selecting an exercise or workout, starting or stopping operation of the first motor 112 and the second motor 114, and other functions of the exercise assembly 100.

Referring now to FIG. 5, a storyboard-style illustration 500 of the exercise assembly 100 operating to provide a bench press exercise is shown, according to some embodiments. The storyboard-style illustration 500 shows a first frame 502 and a second frame 504 which illustrate a process of providing a bench press exercise. In the example of FIG. 5, the bar 408 is connected to the first cable 118 and the second cable 120 as described with reference to FIG. 4.

In the example of FIG. 5, the exercise assembly 100 includes a bench 506. The bench 506 is configured to be placed on the base platform 102 and to support a user sitting or lying on the bench 506. For example, the bench 506 may include legs or supports and a padded deck that provides a comfortable lying position for a user. In some embodiments, the bench 506 includes a projection that engages with a recess or other feature of the base platform 102 to enable repeatable, reliable positioning of the bench 506 relative to other elements of the exercise assembly 100. In some examples, the bench 506 is symmetrically positioned between the first stanchion 104 and the second stanchion 106.

In the first frame 502, the user lies on the bench 506 with arms extended upwards, holding the bar 408 above the user's chest. A force approximately equal to double the tension generated by the first motor 112 plus double the tension generated by the second motor 114 is provided on the bar 408, pointing downwards towards the user's torso.

Between the first frame 502 and the second frame 504, the force on the bar 408 generated by the first motor 112 and the second motor 114 exceeds an upward force on the bar 408 by the user, such that the bar 408 moves downwards towards the base platform 102, the bench 506, and the user. During such a motion, the first cable 118 is retracted by the first motor 112 and the second cable 120 is retracted by the second motor 114.

To continue to perform the bench press exercise, the user stops motion of the bar 408 proximate the user's chest as shown in the second frame 504 by increasing an upward force on the bar 408 to match the downward force on the bar 408 generated by the first motor 112 and the second motor 114. The user can then increase the user's force on the bar 408 to exceed the force provided on the bar 408 via the first cable 118 and the second cable 120, thereby accelerating the bar 408 upwards and to the position shown in the first frame 502.

To perform multiple repetitions, the exercise apparatus 100 and the user can repeatedly cycle between the first frame 502 and the second frame 504. In some scenarios, the first motor 112 and the second motor 114 operate to provide substantially constant tensions in the first cable 118 and the second cable 120. In some scenarios, the first motor 112 and the second motor 114 are controlled to dynamically adjust the tensions in the first cable 118 and the second cable 120, for example, such that the tension is higher during a first transition phase between the first frame 502 and the second frame 504 compared to during a second transition phase between the second frame 504 and the first frame 502, or vice versa. As another example, the tensions can be increased or decreased between repetitions (e.g., decreasing with each cycle through the first frame 502 and the second frame 504).

Referring now to FIG. 6, a storyboard-style illustration operation of the exercise assembly 100 to provide an arm exercise is shown, according to some embodiments. FIG. 6 shows an exercise involving a single cable (second cable 120 in the example shown) under a force having a one-to-one correspondence with the tension in the second cable 120 generated by the second motor 114. The arrangement of FIG. 6 can be selected by a user to switch from exercises as in FIGS. 4-5 to different types of exercises, such as the one illustrated in FIG. 6.

As shown in FIG. 6, a handle 606 is connected to the second cable 120 via a second connection point 608. The second connection point 608 is located on a distal end of the second cable 120, and can be configured the same as the second connection point 220 associated with the first cable 118 and described above, with the exception of being coupled to the second cable 120. For example, the handle 606 can be coupled to a loop of the second connection point 608 by a carabineer or other type of clip or latch.

To transition from the example of FIG. 4 to the example of FIG. 5, the user can detach the bar 408 from the first connection point 212 and a corresponding first connection point associated with the second cable 120, set the bar 408 aside, obtain the handle 606, and connect the handle 606 to the second connection point 608. Through such a process, the exercise assembly 100 is reconfigured from providing an exercise subject to double the tensions generated by the first motor 112 and the second motor 114 to an exercise subject to a force corresponding to the tension generated by one of the motors (i.e., by the second motor 114 in the example of FIG. 6) without the force multiplication effect described above with reference to FIGS. 3-5.

Still referring to FIG. 6, the first frame 602 shows the user beginning to exert a force on the handle 606 pulling the handle 606 away from the second terminal 124, thereby pulling the second cable 120 through the second terminal 124. The second motor 114 resists this pulling/extraction motion, as the user exceeds the force provided by the second motor 114 to transition from the first frame 602 to the second frame 604.

As shown in the second frame 604, the user has pulled the handle 606 away from the second terminal 124, resisted by the tension in the second cable 120 (i.e., by a force pointing toward the second terminal 124). The length of the second cable 120 between the handle 606 and the second motor 114 has increased accordingly between the first frame 602 and the second frame 604. The user can then reduce the force exerted by the user on the handle 606 to allow operation of the second motor 114 to pull the handle 606 back toward the second terminal 124 as the second motor 114 retracts the second cable 120. The exercise assembly 100 thus provides for repeated cycling through the first frame 602 and the second frame 604 to allow performance of an exercise.

Various exercise can be enabled by the arrangement shown in FIG. 6, including by attaching different types of handles that can be included with the exercise assembly 100 and by adjusting the position of the second terminal 124 along the second stanchion 106. In some scenarios, a separate handle is also connected to the second connection point 220 coupled to the first cable 118, such that an exercise can be performed by simultaneous experiencing decoupled forces generated by the first motor 112 and the second motor 114. Various such examples can be performed in various embodiments.

In some embodiments, the exercise assembly 100 includes one or more sensors or detectors configured to provide data indicative of where the user selected to attach an exercise implement (e.g., bar 408, handle 606) to the first cable 118 and/or the second cable 120, e.g., at a first connection point 212 or a second connection point 220, for example. In some such embodiments, the exercise assembly 100 includes a sensor configured to determine if the moveable pulley is in the default/bottom position (i.e., as shown in FIG. 2, between/below the first fixed pulley 206 and the second fixed pulley 208. For example, the sensor may be a proximity sensor, a physical switch sensor, or a through beam sensor. If a user has connected to and is using the first connection point 212, such a sensor can detect that the first connection point 212 has moved from its default position and is therefore in use. If the first connection point 212 is detected as being at the default position, the sensor data indicates that the second connection point 220 is being used for an exercise. Such data (e.g., sensor output) can be provided to a controller and used to control the first motor 112 and/or the second motor 114. In other embodiments, the user may input an indication of which connection was selected via a touchscreen, keypad, or other input device of the display console 108 or via a remote control device. For example, a user may select between various exercise (e.g., squat, bench press, row, etc.) which are associated with different motor controls and different connection points, causing the first motor 112 and the second motor 114 to be controlled to provide suitable behavior of the exercise assembly 100 for the selected exercises. Various other motor control strategies, preprogrammed workouts, user customizations, digital interactivity, etc. can be provided by or via the exercise assembly 100.

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

The hardware and data processing components used to implement the various processes, operations, illustrative logics, logical blocks, modules and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. The memory (e.g., memory, memory unit, storage device) may include one or more devices (e.g., RAM, ROM, Flash memory, hard disk storage) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein.

The present disclosure contemplates methods, systems and program products on any machine-readable media for accomplishing various operations. The embodiments of the present disclosure (e.g., including the controller(s) discussed herein) may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

What is claimed is:

1. An exercise apparatus, comprising:

a cable;

a motor configured to apply a tension to the cable;

a first pulley;

a second pulley;

a first connection point configured to selectively redirect the cable through a gap between the first pulley and the second pulley such that the first connection point experiences a first force corresponding to double the tension; and a second connection point coupled to the cable and experiencing a second force corresponding to the tension.

2. The exercise apparatus of claim 1, further comprising a handle, wherein:

the cable is redirected by the first pulley and the second pulley when the handle is coupled to the first connection point and in use for a first exercise; and the cable passes the first pulley and the second pulley without being redirected by the first pulley and the second pulley when the handle is coupled to the second connection point and in use for a second exercise.

3. The exercise apparatus of claim 1, further comprising a base, wherein the first pulley and the second pulley are positioned at the base.

4. The exercise apparatus of claim 3, comprising a terminal positioned above the base, wherein the cable is routed such that the second connection point is positioned at the terminal when not in use for performance of an exercise.

5. The exercise apparatus of claim 4, further comprising a stanchion, wherein the terminal is coupled to the stanchion and repositionable along the stanchion.

6. The exercise apparatus of claim 1, wherein the first connection point comprises a loop, the cable extending through the loop.

7. The exercise apparatus of claim 1, wherein the second connection point is positioned at a moveable terminal when not in use for performance of an exercise.

8. The exercise apparatus of claim 1, wherein the second connection point comprises a ball stop positioned at a distal end of the cable.

9. An exercise apparatus, comprising:

a base;

a stanchion coupled to the base;

a cable;

a motor coupled to the base and configured to apply a tension to the cable;

a first connection point positioned at the base; and a second connection point positioned at the stanchion;

wherein the cable is routed such that the first connection point is configured to experience double the tension and the second connection point is configured to experience the tension.

10. The exercise apparatus of claim 9, wherein the cable extends from the motor to the second connection point via the first connection point.

11. The exercise apparatus of claim 9, further comprising an exercise implement configured to be selectively coupled to the first connection point and the second connection point at different times.

12. The exercise apparatus of claim 11, wherein:

the exercise implement is usable by a user to perform a first weight training exercise resisted by a first force corresponding to double the tension when the exercise implement is coupled to the first connection point; and the exercise implement is usable by the user to perform a second weight training exercise resisted by a second force corresponding to the tension when the exercise implement is coupled to the second connection point.

13. The exercise apparatus of claim 9, further comprising a first pulley and a second pulley, wherein the first connection point is moveable through a gap between the first pulley and the second pulley.

14. The exercise apparatus of claim 9, wherein the first connection point comprises a loop, the cable extending through the loop.

15. The exercise apparatus of claim 9, wherein the second connection point comprises a ball stop positioned at a distal end of the cable.

16. An exercise apparatus, comprising:

a cable;

a motor configured to apply a tension to the cable;

a first connection point positioned along the cable between the motor and a distal end of the cable, wherein the cable extends through the first connection point, and wherein the first connection point is configured to experience double the tension when in use; and a second connection point at the distal end of the cable, wherein the second connection point is configured to experience the tension when in use.

17. The exercise apparatus of claim 16, comprising a first pulley and a second pulley, wherein the first connection point is moveable through a gap between the first pulley and the second pulley such that, when the first connection point is in use, the cable is redirected by the first pulley, the first connection point, and the second pulley.

18. The exercise apparatus of claim 16, wherein the cable extends through a loop of the first connection point.

19. The exercise apparatus of claim 16, comprising a moveable terminal, wherein the second connection point is positioned at the moveable terminal when not in use.

20. The exercise apparatus of claim 16, wherein the second connection point comprises a ball stop coupled to the distal end of the cable.

* * * * *